US005226406A

United States Patent [19]

Reynolds

[11] Patent Number: 5,226,406

[45] Date of Patent: Jul. 13, 1993

[54] VENTED MULTI-WOK COOKING RANGE

[75] Inventor: Howard S. Reynolds, Monterey Park, Calif.

[73] Assignee: Connerton Appliance Company, Orange, Calif.

[21] Appl. No.: 871,134

[22] Filed: Apr. 20, 1992

[51] Int. Cl.[5] ..... F24C 3/00

[52] U.S. Cl. ..... 126/39 R; 126/39 D; 126/39 E; 126/312

[58] Field of Search ..... 126/345, 391, 392, 389, 126/261, 268, 265, 39 E, 40, 34 BA, 299 R, 299 D, 307 R, 312; 99/403, 413, 415, 348, 339; 126/261, 268, 265, 39 E, 40, 34 BA, 299 R, 299 D, 307 R, 312

[56] References Cited

U.S. PATENT DOCUMENTS

| | | | |
|---|---|---|---|
| 1,270,386 | 6/1918 | Detwiler | 126/39 D |
| 1,603,111 | 10/1926 | Howe | 126/39 D |
| 4,435,638 | 3/1984 | Simon et al. | 126/39 E X |
| 4,984,558 | 1/1991 | Lok | 126/39 R |
| 5,044,352 | 9/1991 | Lok | 126/39 R |

*Primary Examiner*—Larry Jones
*Attorney, Agent, or Firm*—William H. Maxwell

[57] ABSTRACT

A cooking range, specially for stir-fry cooking, characterized by an imperforate work top through which a chimney-like burner collar opens and which is covered and closed by a frying pan placed thereupon, with a lateral opening through said collar and discharging beneath the work top for lateral induction of the flame products of combustion to exhaust through a remote flue, preferably embodied is a stepped work top with pairs of tiered burner collars, whereby a multiplicity of frying pans are simultaneously employed.

17 Claims, 2 Drawing Sheets

VENTED MULTI-WOK COOKING RANGE

BACKGROUND OF THE INVENTION

This invention has to do with the traditional Chinese wok which heretofore has been manipulated over an open flame. The wok is a concavo-convex dish-shaped cooking vessel or frying pan of round and shallow configuration with a radially disposed handle. The wok is used for high heat stir-fry cooking with the use of oils in the preparation of vegetables, and meats with a wide variety of condiments. Originally, a tall and hot wood fired flame was provided, over which the wok was held in order to intensely heat its center bottom portion, the fire spilling upwardly from its perimeter and discharged into the surrounding atmosphere. Modernly however, cooking ranges are provided for this purpose, particularly for the preparation of stir-fry foods in restaurants. These cooking ranges have been wood fired and now preferably gas fired, and characterized by a multiplicity of flame openings. It is significant that the flame source has been at a substantial depth below a support aperture for the wok, in each instance. This depth has been traditional so that the wok is heated by a tall hot flame. In practice, using a gas fired burner, said burner and emanating flame has been surrounded by a cylindrical collar open bottom to top as a chimney, the top having a circular rim for supporting the wok bottom. Accordingly, various ways have been devised to prevent stifling of the flame; one of which is the provision of upstanding pegs that prevent closure of the collar; another which is the provision of an angular support ring (or partial ring) that ensures the escape of flames from at least one side of the collar; another which is the provision of side ports below the top rim of the collar to permit the escape of flames when the wok closes the collar; and still another which is the provision of a notch-shaped vent opening in the top rim that permits the escape of the flames to one side when the collar is closed by the wok.

The wok ranges of the type under consideration are characterized by the discharge of flame and the presence of radiant heat, in great amounts. Consequently, the use of multi flame openings, or burners, becomes a problem since the working of one adversely affects the other. That is, the cook person has problems due to unbearable heat emanating from adjacent flame openings, or burners. As a result, wok ranges have resorted to largeness and have been cumbersome in order to widely space the flame openings; and the tops of such ranges have resorted to water cooling. For example, a gas fired range with three flame openings, or burners, will be typically ten to twelve feet in length. The great disadvantage of the prior art wok ranges is that they discharge the combusted flame gases into the atmosphere from the perimeters of the woks. It is significant that the flame induction of the prior art has been within the collar and below the wok bottom. Significantly, it is a general object of this invention to shut off the combusted gases at the top of the aforesaid collar and divert them below the top of the range and to a remote flue that discharges away from the cooking area. It is also an object of this invention to extend the flue induction effect by closing said collar with the wok, whereby the height of the collar is reduced, bringing the burner close to the wok for heat use efficiency.

Heretofore, the flame source burner collar of wok ranges has been terminated at or above the plane of the range top, and this feature has required the provision of the aforesaid pegs, supports, ports and vent notches for the escape of the burning gases. Typically, the collar opens above the range top with a notch in the collar for the flame to escape at the back side away from the cook person. This arrangement has been thought to be satisfactory for wok collars working side by side, but is highly unsatisfactory for one wok collar working behind another. However, it is an object of this invention to work one wok collar behind another, without subjecting the cook person to unbearable heat. With the present invention the gases of combustion are vented away beneath the range top and do not emanate from beneath the wok; only unless the wok is lifted from the burner collar. In practice, the aforesaid collar opening or notch is immediate to the top of the range and contiguous to the bottom of the wok when it is seated on the otherwise open top of the burner collar. Characteristically, the burner collar of this wok range terminates at or below the range top or deck, there being no obstruction on the deck plane.

With the present invention, each burner collar is conspicuous only by a circular opening in the deck plane of the range, an opening from which the burner flame emanates only when the wok is absent. Accordingly, it is an object of this invention to vent the gases of combustion from the top side opening of the burner collar and divert them to a flue where they are drafted by thermal conduction to an exhaust. In practice, this venting away of gases to a flue provides the induction that supplies secondary air to the bottom open end of the burner collar. It is another object of this invention to baffle each burner collar so that its burnt gases are diverted into an effective flue. In practice, a single flue is shared by several burner collars, or a single flue serves a single burner collar, as may be required. A characteristic feature of this burner collar is that the burner is disposed below the top deck of the range where the wok is supported, and the burnt gases of combustion are vented away from beneath said top deck.

The wok range of the present invention is characterized by the absence of heat discharged from its top deck when the wok or woks are in working position. It is an object of this invention to add a front to back relationship of two working woks, without interference of one with the other. This front to back relationship is in addition to the conventional side to side relationship, and is shown herein as a four burner collar range wherein the back burner collars are raised. That is, the top deck is stepped or tiered as shown. In practice, the handles of the woks working on the upper deck can overlie the woks working on the lower deck, and all of which can be manipulated independently. The wok range illustrated herein is 24 inches wide and 30 inches deep, and adapted to accommodate four 12 inch diameter woks.

It is still another object of this invention to provide deck cooling for reducing heat radiation that would be unbearable to the cook person. In accordance with this invention, the secondary air induction into the burner collars is substantially less than the surrounding ventilation air, all of which is induced to exhaust by means of the flue or flues. This ventilation air reduces the top deck temperature and thereby minimizes radiation of heat from the range top surrounding the burner collar openings.

SUMMARY OF THE INVENTION

This invention relates to authentic wok cookery, whereby a wok is intensely heated throughout its center bottom portion, and its surrounding perimeter portion heated as and when circumstances require. The heat source is a gas fired burner surrounded by a collar that provides a chimney effect, the burner being spaced substantially below the top open end of the collar. A feature is that said top open end of the collar is coincident with the deck plane of the range top, and a vent opening in the side of the collar immediately below the range top; as close as possible. Accordingly, when the wok rests upon the top end of the collar, the aforesaid chimney effect is closed and the gases of combustion are diverted through the side vent and beneath the range top. Consequently, flame heat is concentrated coextensively beneath the center bottom portion of the wok. However, when it is desired to apply flame heat to the perimeter portion of the wok, the wok is simply lifted from the collar opening, whereby the flame heat emanates radially beneath said perimeter portion and discharged over the range top; lifting of the wok for peripheral heating is usually but momentary. Another feature is the baffling of the individual burner collars to flues and remote exhaust of the products of combustion. Still another feature is the induction of secondary combustion air separate from ventilation air, and a cooling effect that moderates heat radiation from the range top. In practice, the burners are fired only when covered and closed by a wok. Therefore, the discharge of flame from the range top is eliminated, except for momentary discharge to apply heat to the perimeter portion of the wok. The aforesaid burner collar and range top improvements make possible multi wok front to back arrangements, and the stepped or tiered configuration of the range top deck, all as shown and hereinafter described.

The foregoing and various other objects and features of this invention will be apparent and fully understood from the following detailed description of the typical preferred forms and applications thereof, throughout which reference is made to the accompanying drawings.

THE DRAWINGS

Figure 3:
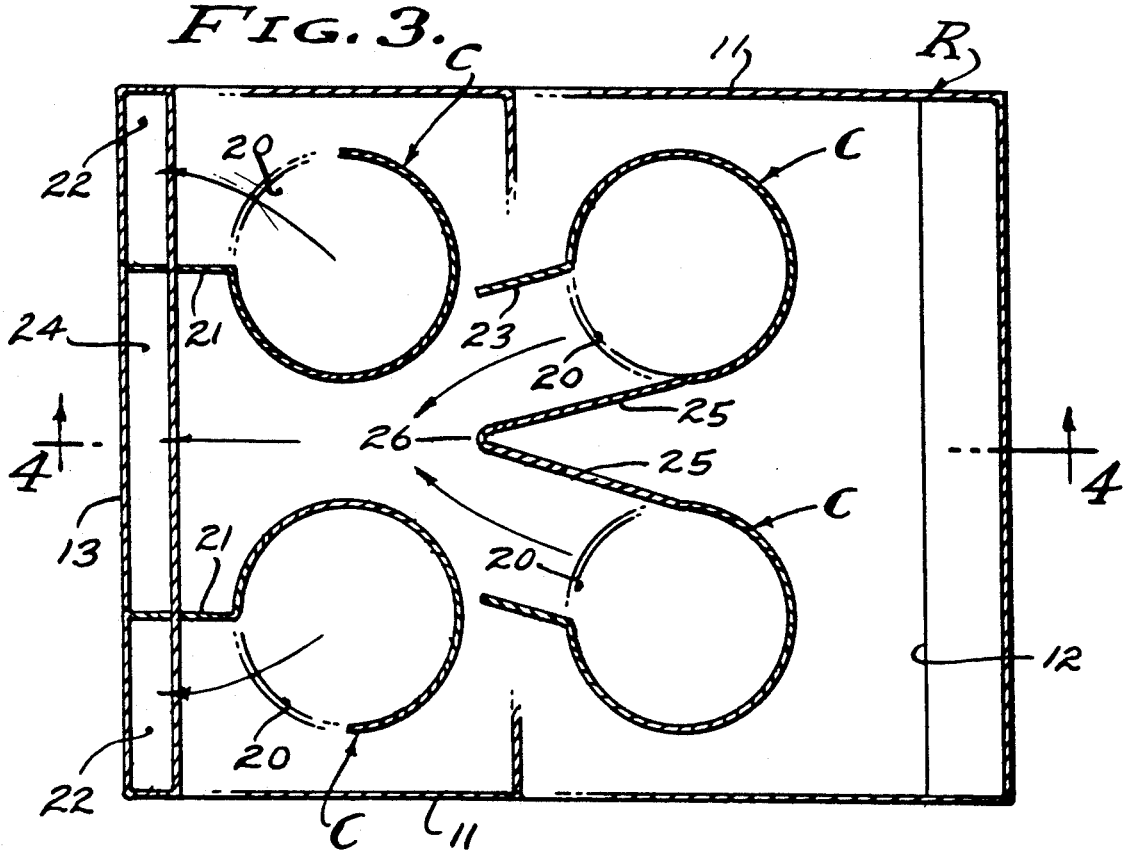
FIG. 3 is a plan section of the range shown in FIG. 1, being a view taken as indicated by line 3—3 on FIG. 4.
Figure 4:
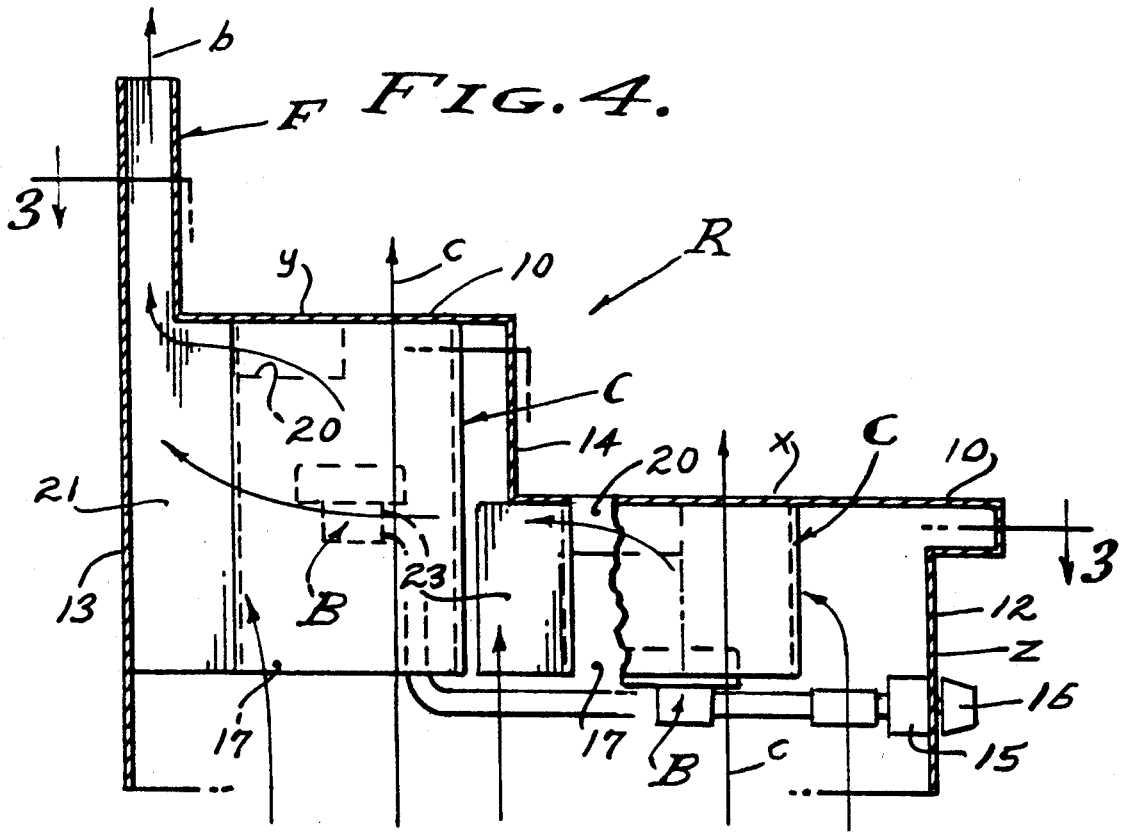

And, FIG. 4 is sectional view taken as indicated by line 4—4 on FIG. 3.

PREFERRED EMBODIMENT

Figure 1:
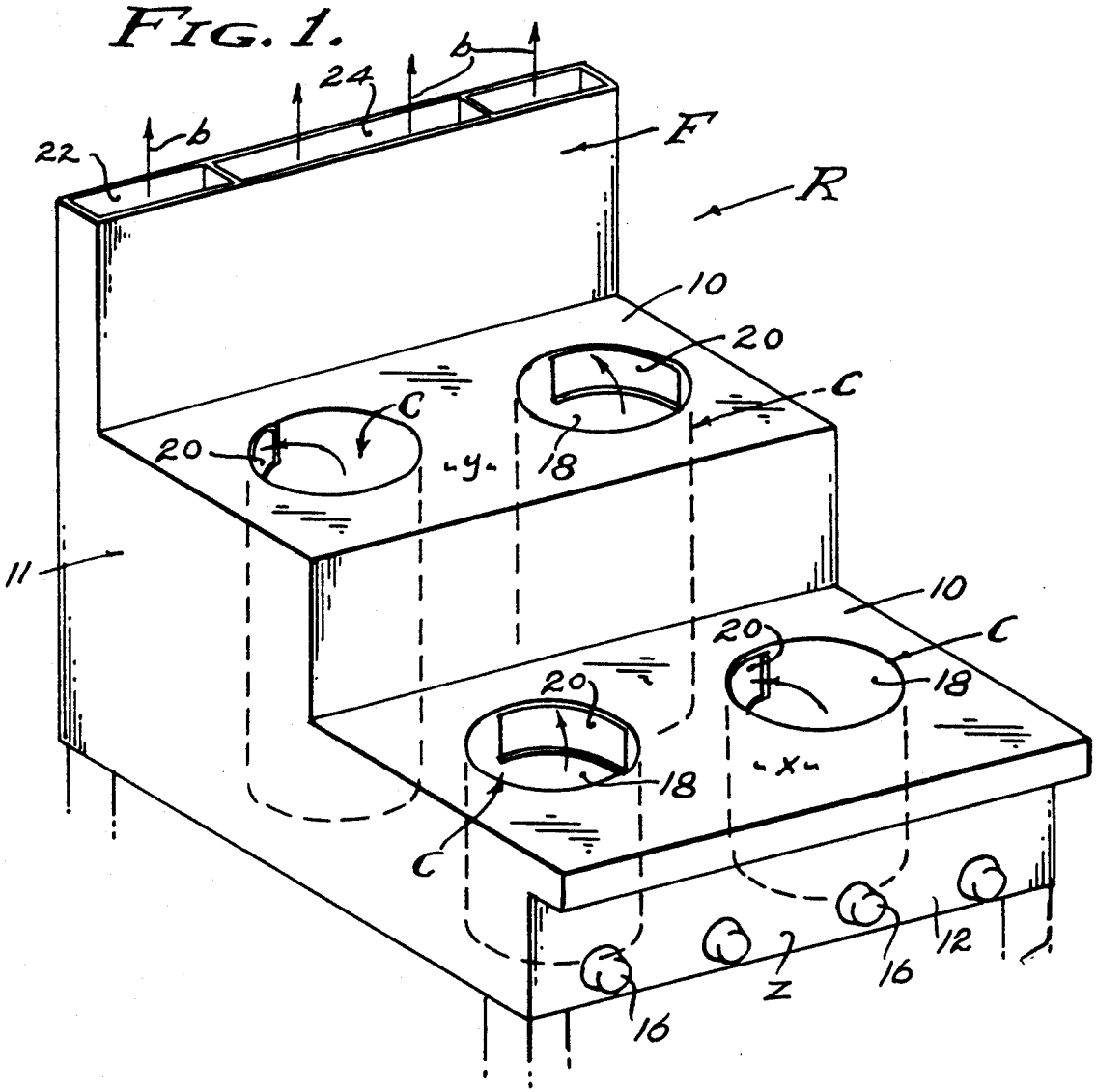
FIG. 1 is a perspective view illustrating the stepped arrangement of burner collars that characterize the vented range of the present invention.
Figure 2:
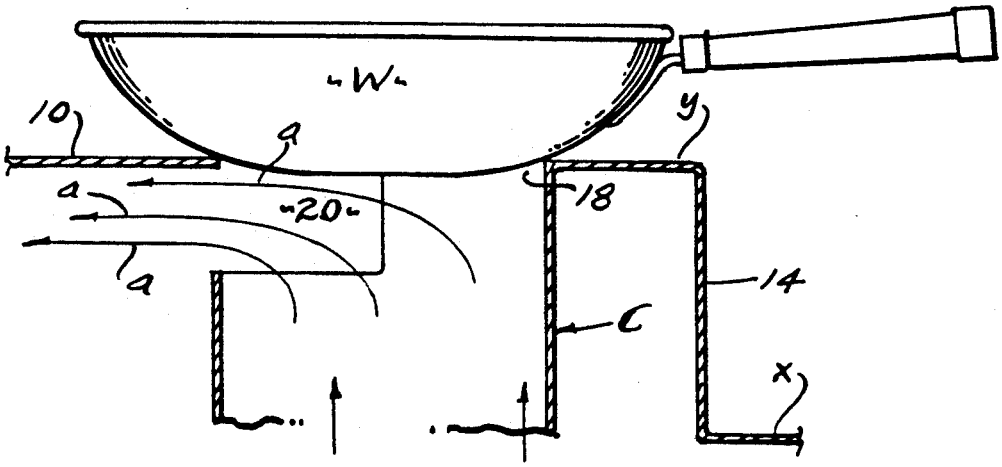
FIG. 2 is an enlarged detailed side view of wok in working position over a burner collar shown in section.

Referring now to the drawings, the cooking range of this invention is characterized by its burner collars C that open at a planar work top 10 as shown in FIG. 1, and closed by a wok W as shown in FIG. 2. As is clearly shown in FIG. 2, the gas products of combustion are directed laterally as shown by arrows a, and they are discharged from flue F, at the back of the range as shown in FIG. 1. The gasses of combustion are not discharged around the wok when it is seated over the burner collar C as shown. An advantageous feature is the tiered or stepped placement of the burner collars C one behind (or in front) of another. Accordingly, two woks or the like can be manipulated simultaneously within a confined area, an area in practice little or no larger than the sum of the two wok diameters. In carrying out this invention, multiple stepped pairs of burner collars are combined side by side, two such pairs being shown; it being understood that two or more pairs of stepped burner collars C are to be combined as required, for example three etc. A preferred multiplicity of two pairs of stepped burner collars C is shown and described.

The range R is shown as a shell having an imperforate work top 10 extending horizontally from side to side 11, and from a front 12 to a back 13. The bottom is open for the supply of secondary combustion air, and for ample ventilation and convection cooling air induced to flow by virtue of the flue function. Basically, a single burner collar C can be employed, however the tiered or stepped combination shown is much to be desired. Accordingly, the work top 10 is stepped by an intermediate transverse riser 14 that integrally joins the front and back top sections x and y, there being an apron z depending from the foremost work portion of section x. The flue F projects vertically from the rearmost portion of section y, and all of which can be a welded fabrication of sheet metal as is indicated.

The range R disclosed is gas fired with a burner B at or within each burner collar C, supplied with gas mixed with primary air at a mixture control and valve means 15. Control knobs 16 are accessible at the front of apron z. In practice, for the purpose of stir-fry cooking, an intensely heated wok is required, the burner B being adjusted to produce a substantially tall flame confined vertically within the burner collar C, a flame usually exceeding the height of said burner collar. In accordance with this invention, it is this exceedingly tall flame that is diverted and prevented from emanating over the work top 10. Pilot means (not shown) is provided for lighting each burner when it is to be used and the burner collar closed by a wok. That is, the burner B is turned on only when a wok is to be in place (see FIG. 2).

The burner collar C is a chimney element, open from bottom to top for the convection flow of secondary air from beneath the range, as indicated by the arrows c in FIG. 4. As shown, a bottom opening 17 surrounds the burner B, and a top opening 18 emanates at the work top 10 to be closed by the wok W. In practice, each burner B is spaced 5 inches to 11 inches beneath the top opening 18, and the burner flame is adjusted accordingly to produce a traditional tall flame as hereinabove described. As shown in FIG. 4 of the drawings, the front burner opening 17 is spaced 5 inches beneath its opening 18, and the back collar opening 17 is spaced 11 inches beneath its opening 18.

In accordance with this invention, the burner collar C is a cylindrical tube having a laterally open vent notch 20 at and preferably immediate to the underside of the work top 10 of the range. In practice, this notch 20 provides a substantial opening for the free flow of the gasses of combustion from beneath the wok W that closes the opening 18. As shown for example, a quarter side section of the burner cylinder is removed to a depth of two inches, and faced laterally toward the back 12 of the range, whereby the top of the burner flame and the gasses of combustion emanate from beneath the wok and contiguous to the bottom side of the work top 10 and progress toward the flue F.

The flue F is coextensive with the back 12 of the range and projects substantially above the top tier or step and/or work top 10, and is open to discharge above the range remote from the front thereof. Significantly, the flow of the gasses of combustion does not discharge over the work top, nor does any one burner collar C discharge into or toward the area of another adjacent burner collar. The flue F is an open chimney, open from the space beneath the work top 10 and through which the gasses of combustion emanate as indicated by arrows b.

In accordance with this invention, the multiplicity of burner collars C are directed so that each is directed to individually discharge its gasses of combustion without interference from or with the others; regardless of which burner collars C are in use. To this end, each burner collar C is firstly faced away from and secondly baffled from a next adjacent burner collar C, either side by side or front to back. In the embodiment shown, the vent notches 20 of back burner collars C are faced rearwardly and outwardly toward the sides 11 of the range, and the front burner collars are face rearwardly and inwardly between the back burner collars. Ducting isolates the discharge of each back burner collar C, in the form of a vertically disposed baffle 21 extending from the inside edge of each vent notch 20 and to the back 13 of the range; thereby confining gasses of combustion therefrom to an outside portion 22 of the flue F. And, ducting isolates the discharge of each front burner collar C, in the form of a baffle 23 extending from the outside edge of each vent notch 20 and to the next adjacent back burner rearward thereof; thereby confining gasses of combustion therefrom to pass by or between the back burner collar or collars C and to an inside portion 24 of the flue F between and/or separated from the outside portion or portions 22 of the flue. When front burner collars C are arranged side by side, inside baffles 25 extend rearwardly from the inside edges of each vent notch 20 and converge to an apex 26, so that the discharge of the two side by side burner collars merge together so as to discharge through portion 24 of the flue. The gasses of combustion together with the ventilation cooling air from the open bottom of the range housing, combine and flow rearwardly beneath the work top 10 and discharge by means of convection flow upwardly through the separated portions 22 and 24 of the flue F.

Having described only the typical preferred forms and applications of my invention, I do not wish to be limited or restricted to the specific details herein set forth, but wish to reserve to myself any modifications or variations that may appear to those skilled in the art as set forth within the limits of the following claims.

I claim:

1. A cooking range for intensely heating the bottom of a pan, and including;

a housing comprised of sides depending from an imperforate planar work top and open at its bottom for the induction of air, an imperforate burner collar of substantial height and in the form of a tube with an open bottom end and an opening through the work top, a burner means positioned at the bottom end of the burner collar and spaced beneath the work top to produce a tall flame emanating through the burner collar, there being a side opening through the burner collar and positioned immediately adjacent to the underside of the work top, for discharging the burner flame and its products of combustion laterally beneath and in contact with said work top when said pan is placed upon and closes the opening of the burner collar through said work top, and a vertically disposed flue laterally remote from the burner collar and open to receive and exhaust the burner flame products of combustion emanating beneath said work top.

2. The cooking range as set forth in claim 1, wherein the burner collar induces secondary combustion air for burner operation, the remaining induction air into the housing passing as cooling air immediately beneath the work top and commingled with the burner flame products of combustion and exhausted through the flue.

3. The cooking range as set forth in claim 1, wherein said opening of the burner collar through the work top is in the top planar surface of the work top.

4. The cooking range as set forth in claim 1, wherein the burner means is adjustable to produce a flame at least as tall as the burner collar and emanating therefrom.

5. The cooking range as set forth in claim 1, wherein the flue is positioned at a back side of the housing, and the side opening through the burner collar is faced laterally toward said flue.

6. A cooking range for intensely heating the bottoms of a pair of pans arranged in tiered relation one to the other and for access to a back pan substantially above the heat rising from a front pan, and including;

a housing comprised of sides depending from a stepped work top having lower and upper imperforate front and back sections and open at its bottom for the induction of air, a pair of imperforate burner collars of substantial height and each in the form of a tube with an open bottom end and an opening through one of said work top sections, a burner means positioned at the bottom end of each burner collar and spaced beneath the work top section to produce a tall flame emanating therethrough, there being a side opening through each burner collar and positioned immediately adjacent to the underside of its work top section, for discharging the burner flame and its products of combustion laterally beneath and in contact with its work top section when said pan is placed upon and closes the opening of the burner collar therethrough, and a vertically disposed flue laterally remote from the pair of burner collars and open to receive and exhaust the burner flame products of combustion emanating beneath said work top sections.

7. The cooking range with pans in tiered relation as set forth in claim 6, wherein an imperforate vertical riser joins the stepped work top sections.

8. The cooking range with pans in tiered relation as set forth in claim 6, wherein said opening of each burner collar through its work top section is in the top planar surface of the work top section through which it opens.

9. The cooking range with pans in tiered relation as set forth in claim 6, wherein each burner means is adjustable to produce a flame at least as high as the burner collar at which it is positioned and emanating therefrom.

10. The cooking range with pans in tiered relation as set forth in claim 6, wherein the burner collars opening through the front and back sections of the work top have coplanar bottoms, the burner means being equidistant beneath the work top section through which it opens and being adjustable to produce a flame at least as tall as the burner collar at which it is positioned and emanating therefrom.

11. The cooking range with pans in tiered relation as set forth in claim 6, wherein the flue is positioned at a back side of the housing and opening therefrom at the underside of the back section of the work top, and the side opening through the burner collars being faced toward said flue.

12. A cooking range for intensely heating the bottoms of at least two pairs of pans arranged in tiered side by side relation one to the other and for access to a back pair of pans substantially above the heat rising from a front pair of pans, and including;

a housing comprised of sides depending from a stepped work top having lower and upper imperforate front and back sections and open at its bottom for the induction of air, a pair of imperforate front and back burner collars and each in the form of a tube with an open bottom end and opening through its respective front and back work top section, a burner means positioned at the bottom end of each burner collar and spaced beneath the work top section to produce a tall flame emanating therethrough, there being a side opening through each burner collar and positioned immediately adjacent to the underside of its work top section, for discharging the burner flame and its products of combustion laterally beneath and in contact with its work top section when said pan is placed upon and closes the opening of the burner collar therethrough, and a vertically disposed flue laterally remote from the pair of burner collars and open to receive and exhaust the burner flame products of combustion emantaing beneath and in contact with said work top sections.

13. The cooking range with pairs of pans in tiered relation as set forth in claim 12, wherein an imperforate vertical riser joins the stepped work top section, the side openings through side by side front burner collars being faced rearwardly and inwardly for discharge of their flame products of combustion to pass between side by side back burner collars.

14. The cooking range with pairs of pans in tiered relation as set forth in claim 12, wherein the imperforate vertical riser joins the stepped work top sections, the side openings through side by side front burner collars being faced rearwardly and inwardly for discharge of their flame products of combustion between vertically disposed rearwardly convergent baffles to commingle and pass between side by side back burner collars.

15. The cooking range with pairs of pans in tiered relation as set forth in claim 12, wherein an imperforate vertical riser joins the stepped work top sections, the side openings through each side by side front burner collar being faced rearwardly and inwardly for discharge of flame products of combustion between a pair of vertically disposed rearwardly convergent baffles to commingle and to pass between side by side back burner collars.

16. The cooking range with pairs of pans in tiered relation as set forth in claim 12, wherein an imperforate vertical riser joins ithe stepped work top sections, the side openings through side by side back burner collars being faced rearwardly for separate discharge of their flame products of combustion to pass outside a pair of spaced baffles entering the flue and dividing it into a center portion receiving flame products of combustion from between said back burner collars separate from the discharge of flame products of combustion into separate outside portions of the flue defined by said spaced baffles.

17. The cooking range with pairs of pans in tiered relation as set forth in claim 12, wherein an imperforate vertical riser joins the stepped work top sections, the side openings through each side by side front burner collar being faced rearwardly and inwardly for discharge of flame products of combustion between a pair of vertically disposed rearwardly convergnet baffles to commingle and to pass between side by side back burner collars, and wherein the side openings through side by side back burner collars are faced rearwardly for separate discharge of their flame products of combustion to pass outside a pair of spaced baffles entering the flue and dividing it into a center portion receiving flame products of combustion from between said back burner collars separate from the discharge of flame products of combustion into separate outside portions of the flue defined by said spaced baffles.

* * * * *